United States Patent [19]

Cares et al.

[11] Patent Number: 4,920,768

[45] Date of Patent: May 1, 1990

[54] VAPOR RETAINING CLOTHES TRANSFER SYSTEM

[75] Inventors: Georges Cares, Grand Rapids; Paul Cares, Holland; Louis G. Cares, Caledonia, all of Mich.

[73] Assignee: GPL Partnership, Kentwood, Mich.

[21] Appl. No.: 368,847

[22] Filed: Jun. 20, 1989

[51] Int. Cl.[5] ..... D06F 43/04

[52] U.S. Cl. ..... 68/18 R; 68/210; 98/115.4; 312/1

[58] Field of Search ..... 68/18 R, 210; 134/200; 98/115.3, 115.4; 312/1; 600/21; 414/8, 13, 909

[56] References Cited

U.S. PATENT DOCUMENTS

| | | | |
|---|---|---|---|
| 1,977,386 | 10/1934 | Holes | 312/1 X |
| 3,071,953 | 1/1963 | Rand | 68/18 |
| 3,089,325 | 5/1963 | Robbins et al. | 68/18 |
| 3,094,360 | 6/1963 | Ferrah | 68/210 |
| 3,106,928 | 10/1963 | Rand | 134/79 |
| 3,225,572 | 12/1965 | Robbins et al. | 68/27 |
| 3,264,848 | 8/1966 | Fuhring | 68/210 |
| 3,272,199 | 9/1966 | Matthews | 600/21 |
| 3,416,437 | 12/1968 | Drace et al. | 414/13 X |
| 3,498,092 | 3/1970 | Berry et al. | 68/210 |
| 3,577,752 | 5/1971 | Hertig | 68/210 |
| 3,597,943 | 8/1971 | Gayring | 68/210 |
| 3,742,738 | 7/1973 | Frotriede | 68/210 |
| 3,875,853 | 4/1975 | Pielkenrood | 98/115.4 X |
| 4,262,430 | 4/1981 | Janson et al. | 34/43 |
| 4,499,744 | 2/1985 | Kotter et al. | 68/210 |
| 4,765,352 | 8/1988 | Strieter | 98/115.4 X |
| 4,809,391 | 3/1989 | Soldatovic | 98/115.4 X |

OTHER PUBLICATIONS

Publication entitled "You Can Easily Comply With the OSHA 25 ppm Limit Perkshield"; publication date unknown.

*Primary Examiner*—Philip R. Coe

*Attorney, Agent, or Firm*—Price, Heneveld, Cooper, DeWitt & Litton

[57] ABSTRACT

A transfer system for transferring textile articles laden with solvent from a solvent cleaning machine to a solvent reclaiming machine in a manner that significantly reduces the emission of solvent vapor to the atmosphere. An enclosed transfer vehicle includes a transportable basket, a flexible shroud covering the basket and a pair of sealed gloves for manipulating the machine access doors and the articles being transferred. A frame to which the shroud is attached includes an opening configured to match-up with the access opening of the cleaning/reclaiming machine and a closure for the opening. A collet is attached to either the transfer vehicle or each of the machines in a manner to be positioned between the vehicle opening and the machine access door to seal the interface. The collet is connected with a vapor recovery unit to recover vapors emitted by the articles while being transferred to the vehicle.

24 Claims, 8 Drawing Sheets

FIG. 1
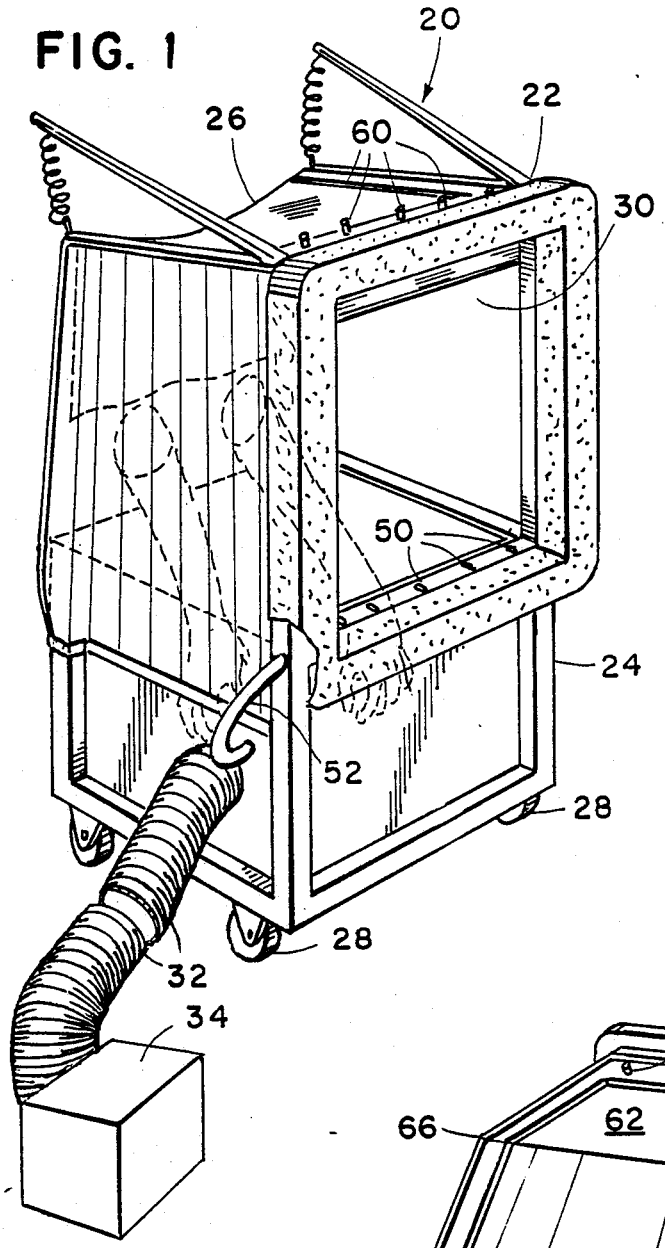
FIG. 2
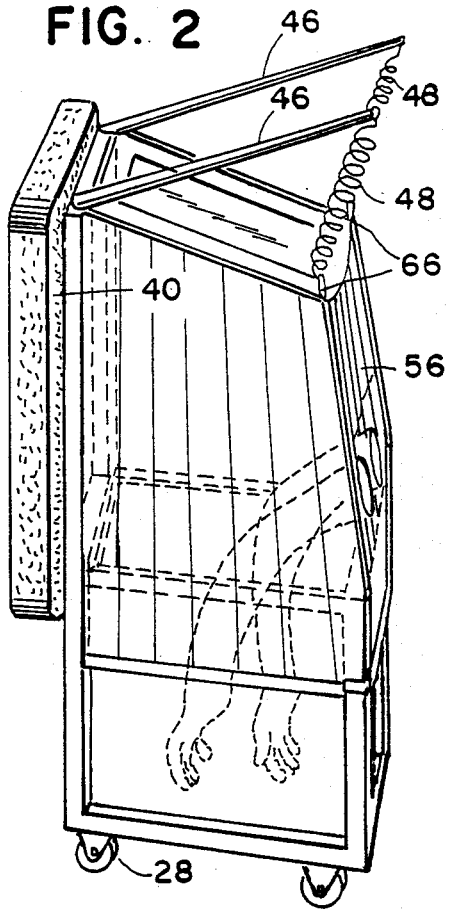
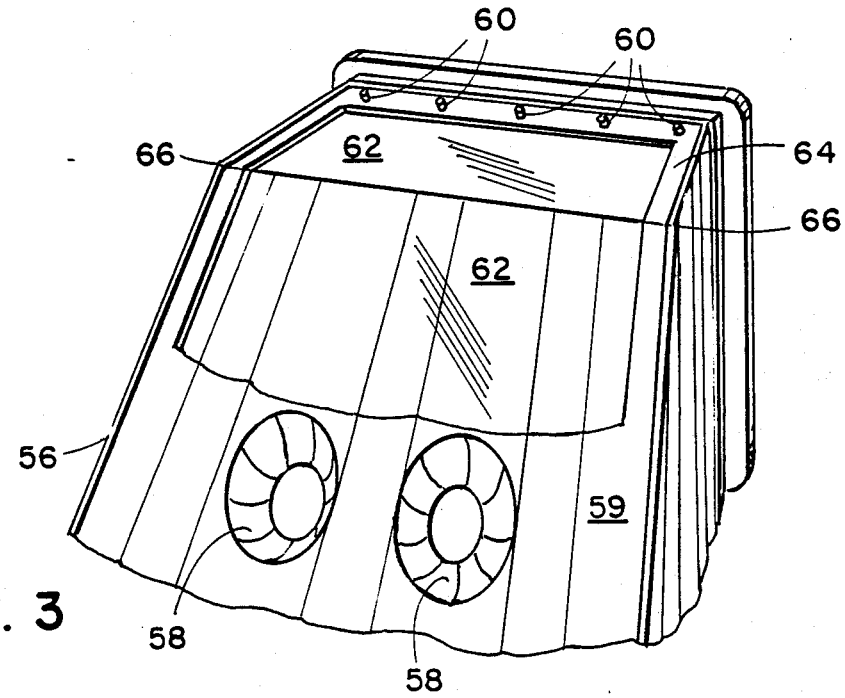
FIG. 3

FIG. 5
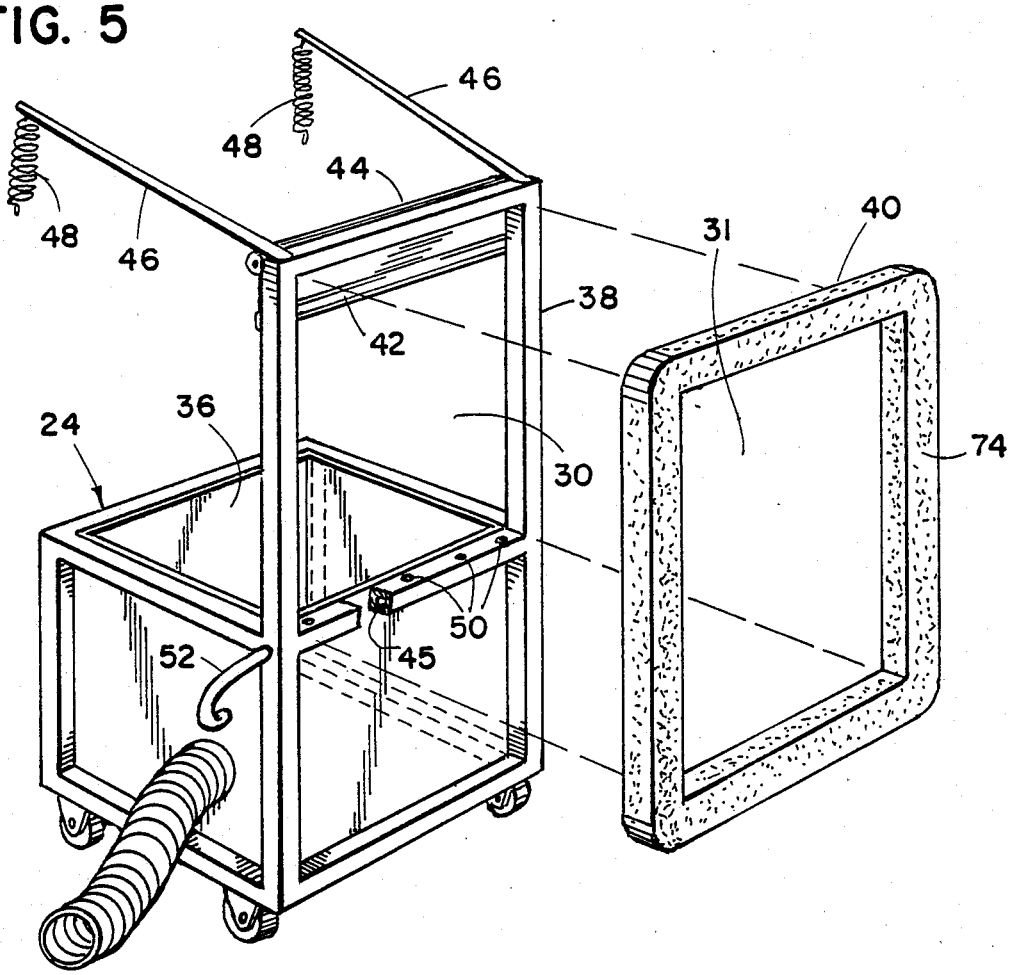
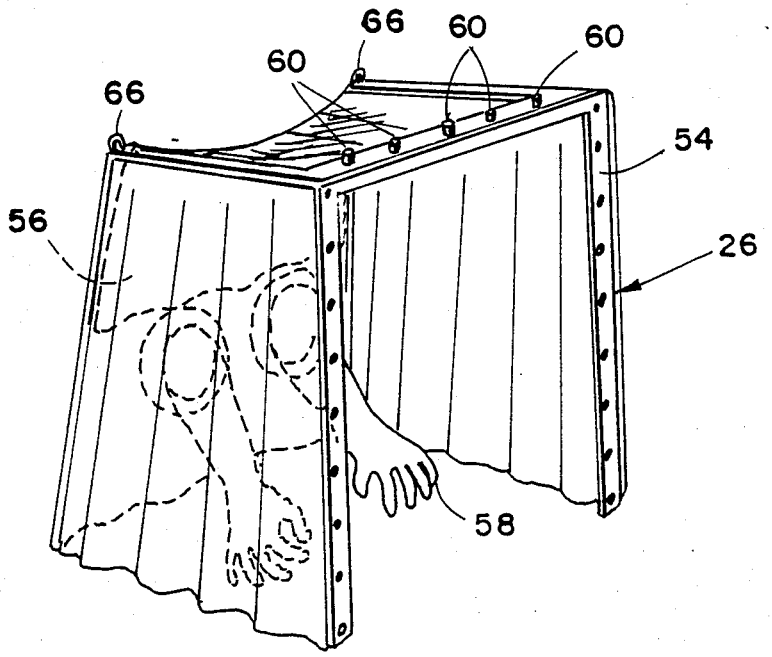
FIG. 4

FIG. 9
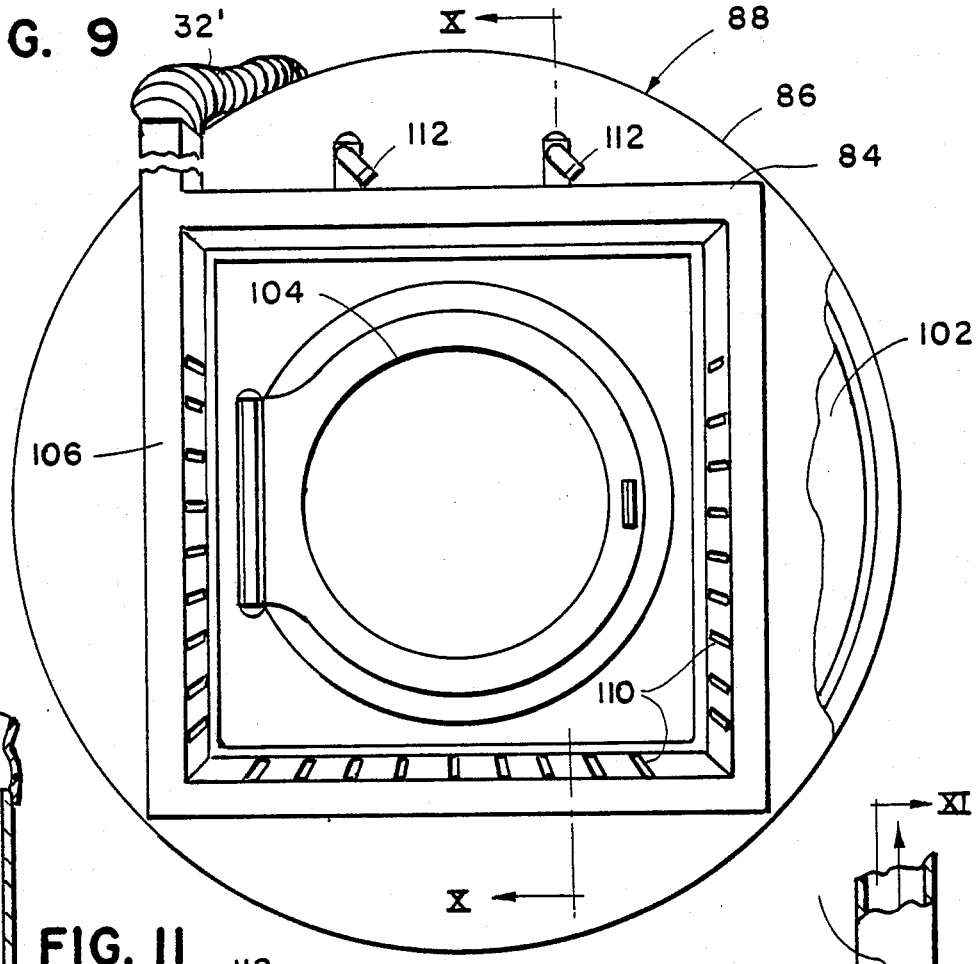
FIG. 11
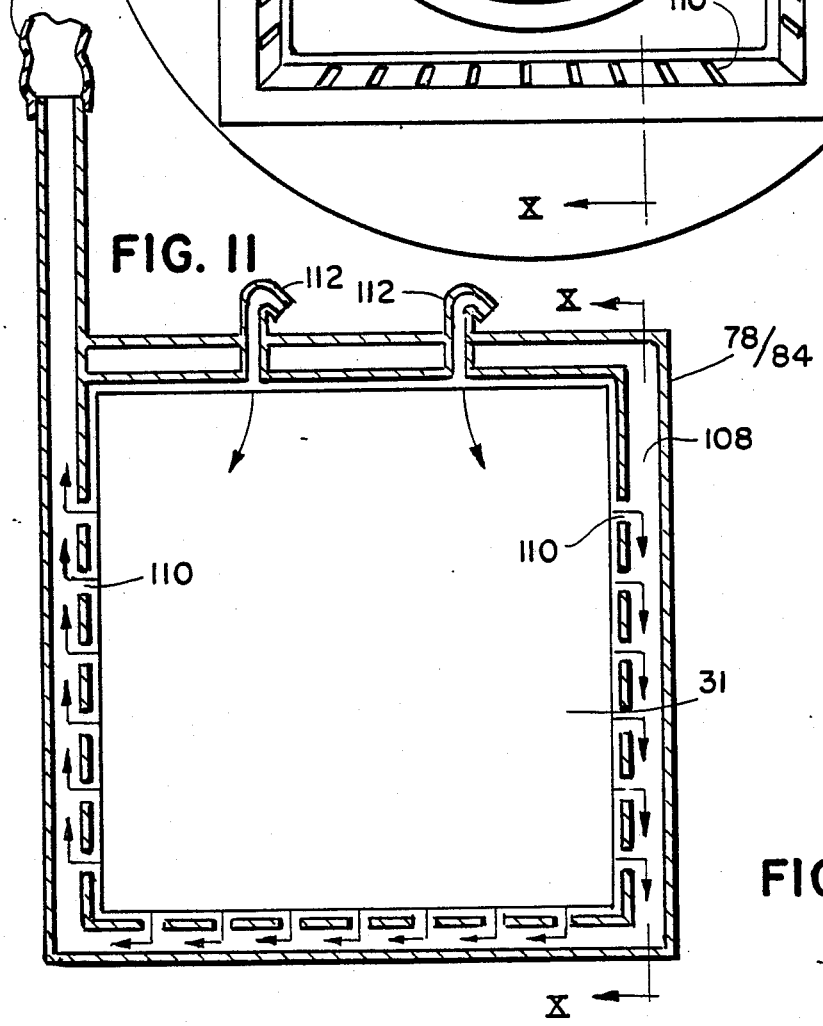
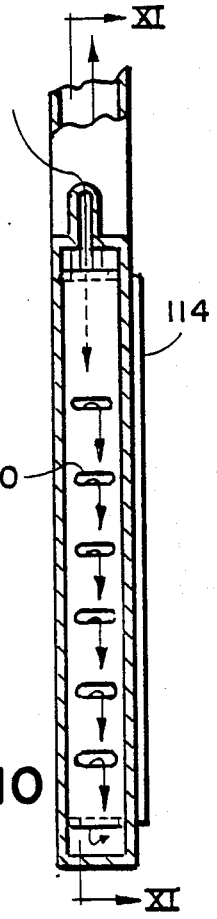
FIG. 10

VAPOR RETAINING CLOTHES TRANSFER SYSTEM

BACKGROUND OF THE INVENTION

This invention relates to a system for the containment of potentially harmful vapor emissions. The invention is especially adapted for use with solvent cleaning systems for fabric articles such as apparel. More particularly, the invention concerns such solvent cleaning systems in which the cleaning of the articles is performed in one unit and the solvent-laden articles are transferred to a second unit for reclaiming of the solvent from the articles.

Solvent cleaning systems for fabrics, commonly known as dry-cleaning systems, agitate the fabrics in the presence of a solvent such as perchlorethylene. The cleaning and an initial extraction operation are performed in a cleaning unit. The solvent-laden fabrics are then transferred by hand, using a wheeled basket, to a solvent recovery unit which recovers the solvent from the fabrics by tumbling the fabrics in the presence of heat. The problem with such a system is that, during the transfer of the solvent-laden articles from the cleaning machine to the reclaiming machine, solvent evaporates from the fabrics, exposing the workers in the cleaning plant to the solvent fumes.

It is known to avoid such difficulty by providing a single dry-cleaning unit that performs both the cleaning function and the reclaiming function in a single treatment chamber. This combination unit avoids the necessity of removing solvent-laden articles from the treatment chamber. The problem with such units is that the reclaiming, or drying, function may take four or five times as long to perform as the cleaning function, thus, resulting in a low through-put of such combination machines. Furthermore, by combining two incompatible functions, such combination units are exceptionally expensive to produce and prone to difficulties in the field.

Therefore, the need exists for a system that utilizes the conventional separate cleaning and reclaiming units while substantially reducing the solvent evaporation during the article transfer step.

SUMMARY OF THE INVENTION

The present invention provides a solution to the problem of solvent evaporation during article transfer in a conventional dry-cleaning system, by confining the solvent-laden clothes during transfer from the cleaning unit to the reclaiming, or drying, unit. The present invention additionally provides for sealingly interconnecting a transfer device with the cleaning unit and the extraction unit in a manner that does not expose the interior of either to the atmosphere. In addition, the present invention provides recovery of substantially all of the solvent vapors that may otherwise evaporate to the atmosphere. Such solutions are provided in a system that is easy to use and provides minimum interference with the operation of a dry-cleaning plant, which is essential to assuring that it will be used.

These and other advantages are realized in an apparatus for transferring articles from a solvent cleaning machine to a reclaiming machine, each of which has an internal article-treating chamber, a front face, an access opening in the front face to the treating chamber and an access closure for selectively closing the access opening. The apparatus includes transporting means for transporting articles having wall means defining a substantially enclosed receptacle and means for conveying the receptacle between the cleaning machine and the reclaiming machine. The apparatus further includes transfer means for transferring articles from the treating chamber of the cleaning machine to the receptacle and from the receptacle to the reclaiming machine including means defining an opening in the wall means and closure means for selectively closing the opening. The apparatus further includes containment means for containing solvent vapor during the transfer of articles including means for selectively sealing the portion of the receptacle wall means surrounding the transfer opening with the portion of the front face surrounding the access opening of the cleaning machine or the reclaiming machine. In this manner, the access closure and the transfer closure can both be opened, when the containing means is positioned between the receptacle and either the cleaning machine or the reclaiming machine, while maintaining a sealed system.

In a preferred embodiment, a first collet is attached to the face of the cleaning machine surrounding the access opening and includes a first outward surface having a predetermined configuration. A second collet is attached to the face of the reclaiming machine surrounding the access opening and includes a second outward surface having substantially the same configuration as the first. A transfer vehicle is provided that includes wall means defining a substantially enclosed portable receptacle having a transfer opening in the wall means and closure means for selectively closing the transfer opening. The transfer vehicle further includes a third outward surface surrounding the transfer opening and configured to selectively sealingly engage the first and second outward surfaces.

Such a system may further include a vapor recovery means for recovering vapor from the first and second collets when the third outward surface is engaged with either of the first or second outward surfaces. Because the collet is preferably affixed to the stationary cleaning machines and reclaiming machines, the vapor recovery means may be included with the stationary units rather than connected with flexible connecting means to a portable transfer vehicle.

These and other related objects, advantages and features of this invention will become apparent upon review of the following specification in conjunction with the drawings.

BRIEF DESCRIPTION OF THE DRAWINGS

FIG. 1 is a perspective view of a vapor retaining clothes transfer system embodying the invention taken from the rear and right sides thereof;

FIG. 2 is the same system illustrated in FIG. 1, except taken from the left side thereof:

FIG. 3 is a perspective view taken from the front and right sides of the flexible shroud portion of the system;

FIG. 4 is a perspective view taken from the rear and right sides of the flexible shroud portion of the system;

FIG. 5 is an exploded perspective view taken from the rear and right side of the system illustrated in FIGS. 1–4 illustrating the carriage portion and the collet portion of a system embodying the invention;

FIG. 9 is a front elevation of a recovery machine according to the alternative embodiment of the invention;

FIG. 10 is a sectional view along the lines X—X in FIG. 9;

FIG. 11 is a sectional view along the lines XI—XI in FIG. 10;

DETAILED DESCRIPTION OF THE PREFERRED EMBODIMENT

Figure 7:
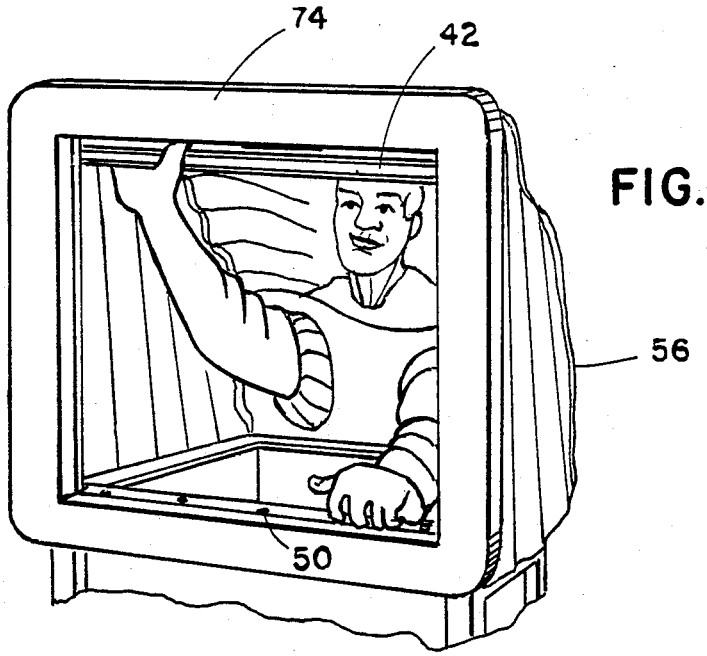
FIG. 7 is an illustration from the rear of the system of an operator closing the transfer closure.

Referring now specifically to the drawings, and the illustrative embodiments depicted therein, a vapor retaining textile transfer system 20 includes a transfer vehicle 22 including a lower carriage member 24 and an upper flexible shroud 26 sealed thereto (FIGS. 1 and 2). Carriage member 24 is made portable by a plurality of casters 28 mounted on a bottom surface thereof. Carriage member 24 and flexible shroud 26 provide a substantially enclosed vehicle with the exception of an enlarged opening 30. A flexible conduit 32, of suitable length to allow the transfer system to be transported between cleaning machines and reclaiming machines, connects carriage member 24 with a stationary vapor recovery member 34.

Carriage member 24 includes a lower article-receiving basket 36, which is enclosed on five sides and open at its top, and an elongated frame 38 extending upwardly from one side of basket 36 (FIG. 5). A collet 40 is fixedly attached to an upper portion 44 of frame 38 which, together, define a transfer opening, or space, for transfer of articles into and out of basket 38. A closure 42 that is movable downwardly in order to close opening 30 is mounted to upper portion 44 of frame 38. A pair of flexible support rods and depending support springs 46, 48 extend forwardly from top portion 44 of frame 38. Upper portion 44 is made from square steel tubing to define an internal plenum, or manifold, 45 completely surrounding opening 30. A plurality of openings 50 provide vents leading to plenum 45. A vent tube 52 extends through the wall of top portion 44 and into plenum 45 to interconnect the plenum with the interior of basket 36.

Flexible shroud 26 includes a semi-rigid mounting flange 54 and a flexible curtain 56 extending forwardly from frame 54 (FIG. 4). A pair of manipulating members 58 extend inwardly from a front surface 59 of curtain 56 and are sealed thereto to maintain the general airtight integrity of the vehicle (FIG. 3). A plurality of check valves 60, mounted at a top portion of mounting flange 54, extend to the interior of shroud 26 and provide air flow into the interior of shroud 26 but not in the opposite direction. Frame 54 is adapted to mounting to a forwardly facing surface (not shown) of upper portion 44 of frame 38. Flexible curtain 56 includes a transparent flexible panel 62 which extends across the top surface 64 and the upper portion of front surface 59 of curtain 56. When mounted to frame 38, forward corners 66 of the shroud are supported by support springs 48.

Collet 40 extends from frame 38 in a direction opposite from that of shroud 26 and includes an internal opening of sufficient height and width to extend completely around the access opening of a solvent cleaning machine and reclaiming machine. In addition, the opening 31 defined by collet 40 and the overall size of shroud 26 must be sufficient to accommodate the opening of the access doors of the cleaning machine and reclaiming machine into the space covered by shroud 26. An outwardly extending surface 74 of collet 40 is generally planar in order to sealingly engage the forward face of the solvent cleaning machine or reclaiming machine.

Curtain 56 is made from rubberized canvas and is sealed at its lower edge to the periphery of basket 36 by suitable fastening means. Manipulating members 58 are configured to the form of human hands and arms and are commercially available rubber gloves sold by Edmont Neox under Model No. 9,430. In the embodiment illustrated in FIGS. 1–7, 18 and 19, collet 40 is made from a rubberized, closed-cell foam. Vapor recovery member 34 is of the charcoal canister type, in which a bed of charcoal absorbs solvent vapors which are drawn into the member 34 by an internal fan (not shown) and which are subsequently recovered during a recovery cycle by heating of the charcoal bed. Such units are conventional and well-known in the dry-cleaning industry. One such unit is sold under the name Environmental Command System by Hoyt Manufacturing under Model No. AVRS-23.

Figure 6:
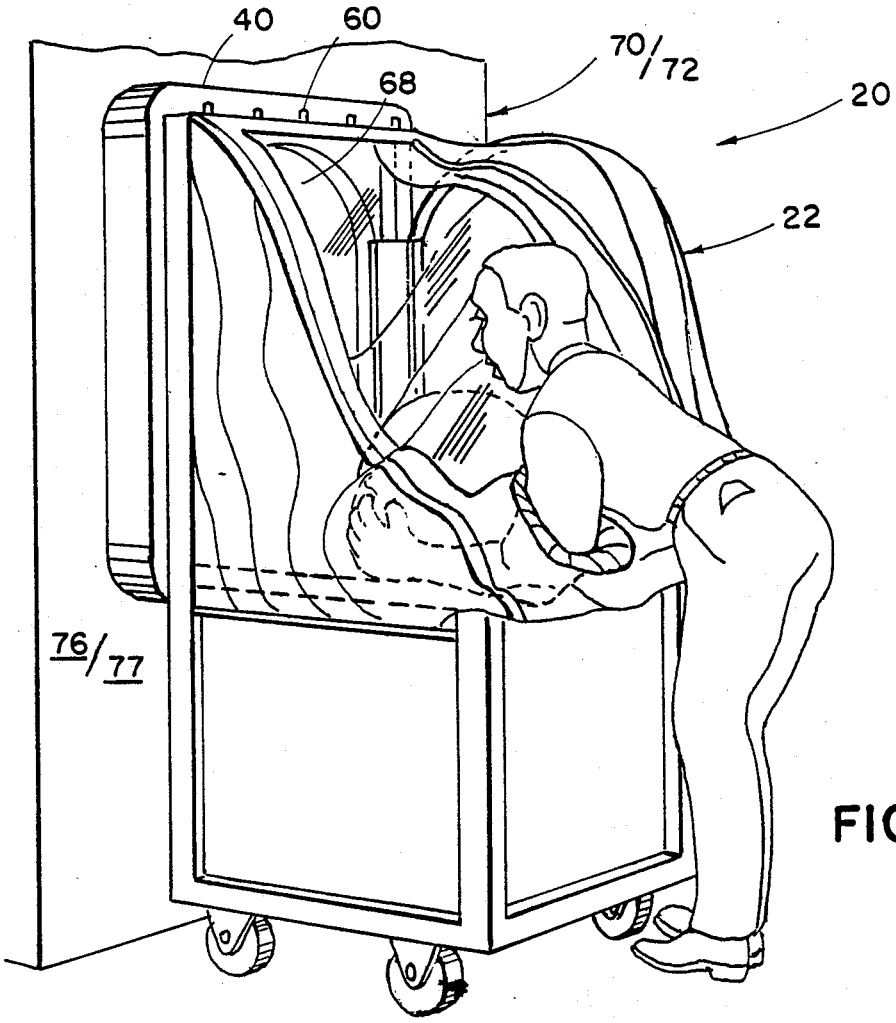
FIG. 6 illustrates the transfer of articles to/from the system.

Operation of the textile transfer system will be set forth with reference to FIGS. 6 and 7. Upon completion of a solvent cleaning process, the transfer vehicle 22 is positioned against the solvent cleaning machine 70 with surface 74 of collet 40 engaging face 76 of the cleaning machine cabinet. With his/her hands and arms in manipulating members 58, the operator opens transfer closure 42 and the access door of the cleaning machine and reaches into the interior of the enclosed transfer vehicle 22 to remove the textile articles into basket 36. Vapors emitted by the articles being transferred to, and while positioned within, basket 36 are removed by the suction developed from recovery member 34 through conduit 32 on basket 36 and, through conduit 52 and plenum 45, to the transfer space defined within collet 40. After the articles are fully transferred into the basket 36 and the access door to the cleaning machine closed, the operator pulls closure 42 over opening 30, as illustrated in FIG. 7. With closure member 42 covering opening 30, the transfer vehicle 22 is substantially fully enclosed. Even with opening 30 covered by closure member 42, the pathway through opening 50 and plenum 45 removes solvent vapors from the space between closure 42 and the access door of the cleaning machine. Thus, when transfer vehicle 22 is pulled away from the solvent cleaning machine, no large pockets of solvent vapors will remain to mix with the atmosphere. Makeup air is provided to the transfer space within collet 40 through check valves 60 in order to prevent a vacuum from being drawn which may prevent the transfer vehicle from being separated from the cleaning machine.

The transfer vehicle is then manually transported to the location of the reclaiming machine 72 with flexible conduit 32 accommodating such movement. The front surface 74 of the collet is placed against face 77 of the reclaiming machine. With the transfer vehicle 22 in place against the reclaiming machine, the operator opens closure 42 and the access door to the treatment chamber of the reclaiming machine in order to deposit the articles into the reclaiming machine treatment chamber. The access door to the reclaiming machine may then be closed using manipulating members 58. Emissions from the vapor-laden articles will then be confined to the treatment chamber of the reclaiming unit and the vapor recovery unit 34 will scavenge vapors remaining within vehicle 22 and the transfer space within collet 40 before the vehicle is pulled away from the reclaiming unit. Because reclaiming machine 72 produces a strong vacuum within its treatment chamber, additional check valves may be required, mounted to the forward portion of the basket, to prevent collapsing of the shroud into the basket.

Figure 12:
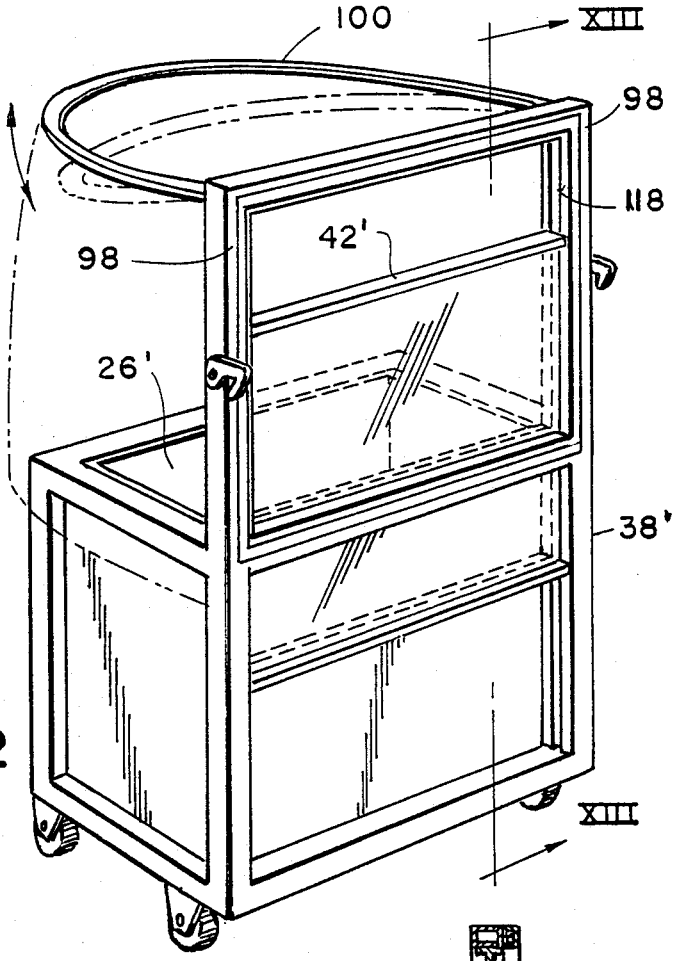
FIG. 12 is a perspective view from the rear and right sides of a transfer vehicle according to the alternative embodiment of the invention illustrated in FIGS. 8–11.
Figure 13:
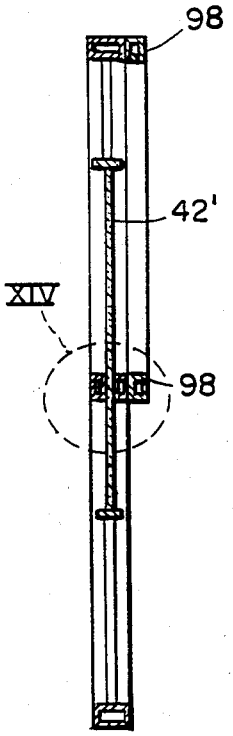
FIG. 13 is a sectional view along the lines XIII—XIII in FIG. 12.
Figure 14:
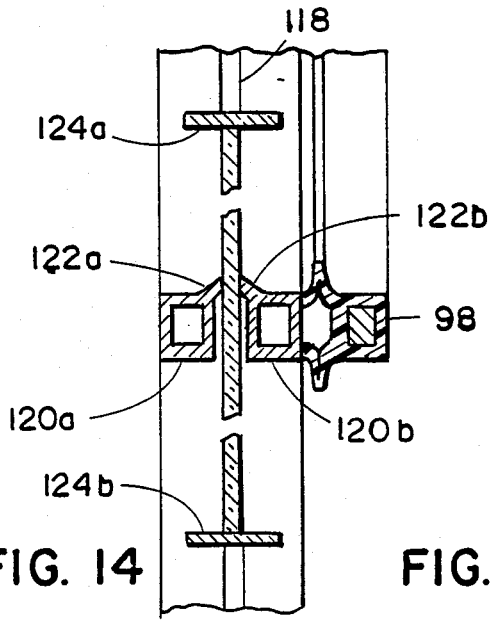
FIG. 14 is an enlarged view of the portion of FIG. 13 illustrated at XIV.
Figure 15:
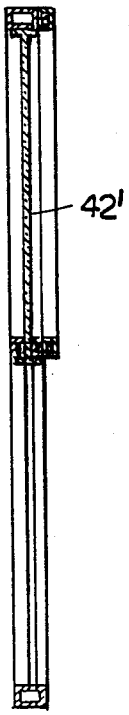
FIG. 15 is the same as FIG. 13 with the transfer closure in a position closing the transfer opening.
Figure 16:
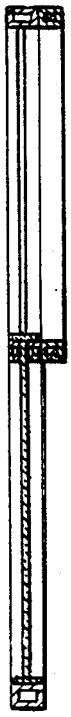
FIG. 16 is the same as FIG. 13 with the transfer closure fully retracted.
Figure 17:
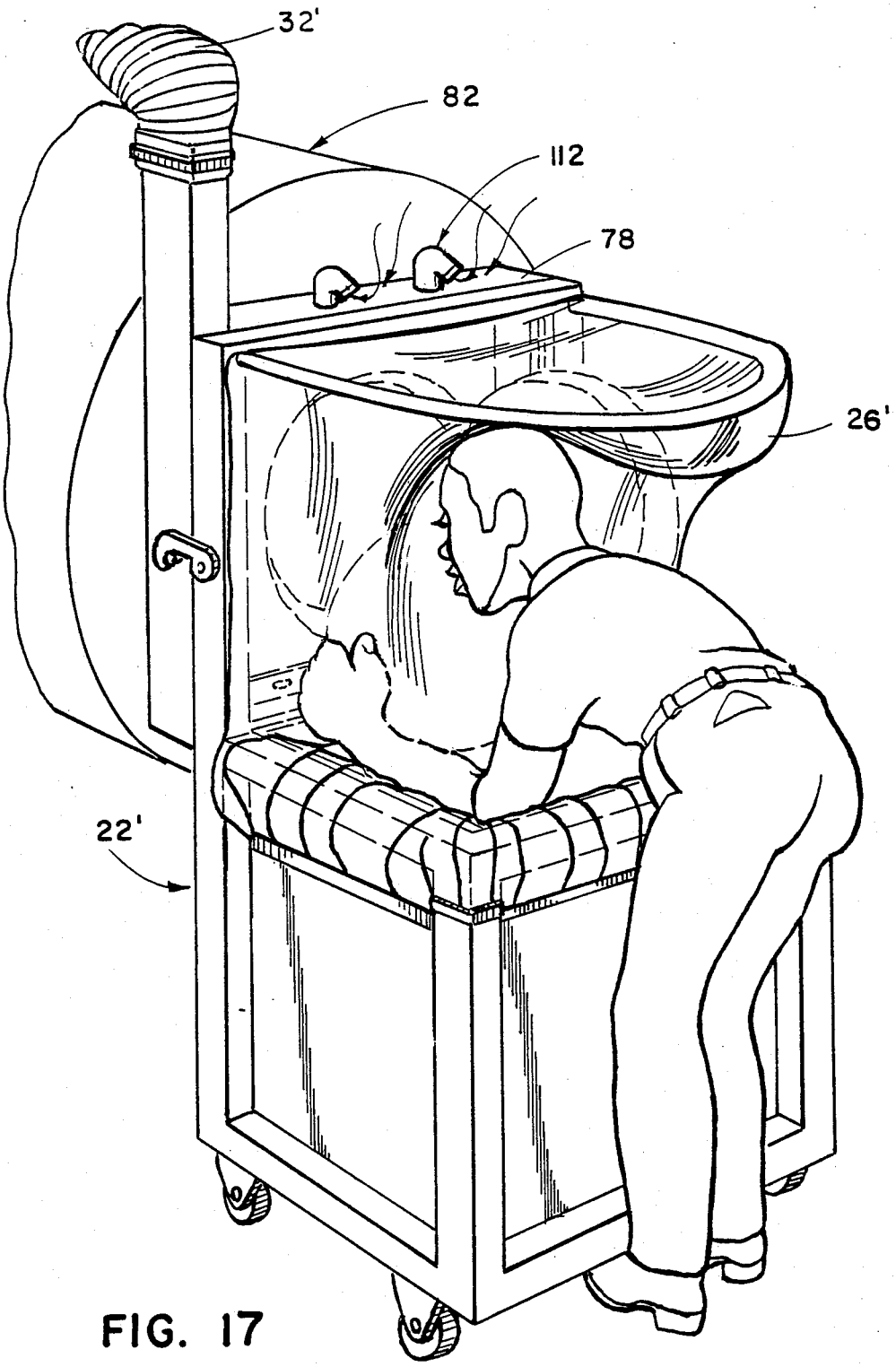
FIG. 17 illustrates the transfer of articles to/from the embodiment of the invention illustrated in FIGS. 8–16.

An alternative, and preferred embodiment of the invention, is illustrated in FIGS. 8–17. In this embodiment, a first collet 78 is fixedly attached to the cabinet 80 of cleaning machine 82 rather than being affixed to the transfer vehicle. Cleaning apparatus 82 includes an article treating chamber 90 and an access closure 92 selectively covering an access opening to chamber 90. Collet 78 is configured to be larger than access door 92 and is attached to the portion of cabinet 80 surrounding the access opening closed by access closure 92. Collet 78 includes a planar, outwardly extending face 94 that matches an outwardly extending face 96 of transfer vehicle 22' (FIG. 12). Outward face 96 includes a sealing member 98 extending around face 96 to provide an essentially airtight interface with outward face 94. In the preferred embodiment, sealing member 98 is a gasket and may be a magnetized gasket. Such magnetized gaskets are conventional and well-known in refrigerator cabinet arts. A mechanical latch on each lateral side of frame 38' retains the frame tightly against the collet.

Reclaiming machine 88 includes an internal treatment chamber 102 and an access closure 104 for selectively closing an access opening through cabinet 86 into chamber 102 (FIG. 9). A second collet 84, which is substantially identical with first collet 78, is attached to the portion of cabinet 86 surrounding access closure 104 and includes an outwardly extending face 106 configured the same as outward faces 94 and 96. Collet 84 is configured to be larger than access closure 104, which is somewhat larger than access closure 92 of the cleaning machine.

Collets 78, 84 are made from square steel tubing defining an internal plenum 108 (FIGS. 10 and 11). A plurality of elongated openings 110 extend inwardly from plenum 108 and one-way air check valves 112 extend entirely through plenum 108 to draw external air to the area 31' confined within collet 84. A seal 114 provides an airtight interface between collets 78, 84 and cabinet 80, 86 (FIG. 10). An extension 116 of plenum 108 is connected with a conduit 32' extending to a vapor recovery member (not shown).

Figure 8:
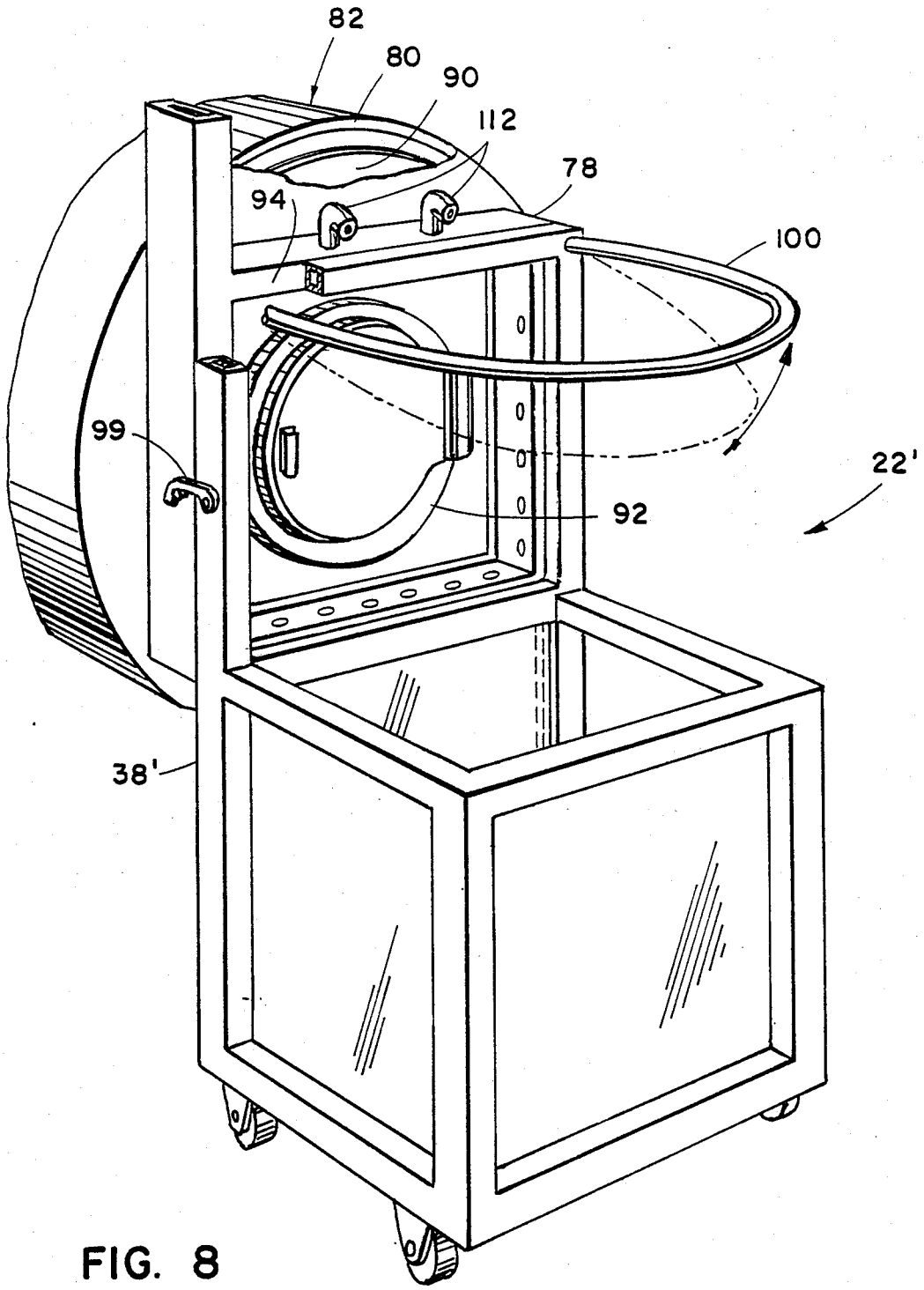
FIG. 8 is a perspective view from the front and left side of an alternative embodiment of the invention including a cleaning apparatus and transfer vehicle with the flexible shroud removed.

Frame 38' includes a vertically extending groove 118 on its facing vertical members to vertically, slidably mount a rigid closure 42'. A pair of horizontal members **20*a*, 120*b* extending along the top edge of basket 36' provide mounting means for gaskets 122*a* and 122*b* which engage the surfaces of closure 42'. Upper and lower magnetic seals 124*a*, 124*b* limit the movement of closure 42' and provide sealing with frame 38' and retention of the closure in its upper and lower positions (see FIGS. 15 and 16). In the preferred embodiment, a U-shaped flexible fiberglass rod 100 extends forwardly from frame 38' to provide flexible support for flexible shroud 26' (FIG. 8**).

In the embodiment illustrated in FIGS. 8–16, there is no requirement for a flexible conduit connecting the plenum defined within the collet with the vapor recovery member. This provides greatly increased mobility of the transfer vehicle 22'. While a collet is required for each cleaning machine and reclaiming machine, the increase in installed cost is offset by the increased ease of use and, hence, increase in productivity with the preferred embodiment system. In addition, the sealed interface between the collet and the cabinet of the cleaning machine, or reclaiming machine, allows the collet to not only recover solvent fumes from the transfer space between transfer door 42' and the cleaning machine access door 92, after both have been closed following transfer of solvent-laden articles to basket 36', but also collects any liquid solvent or fumes that may spill out of treatment chamber 90 during article transfer.

Figure 18:
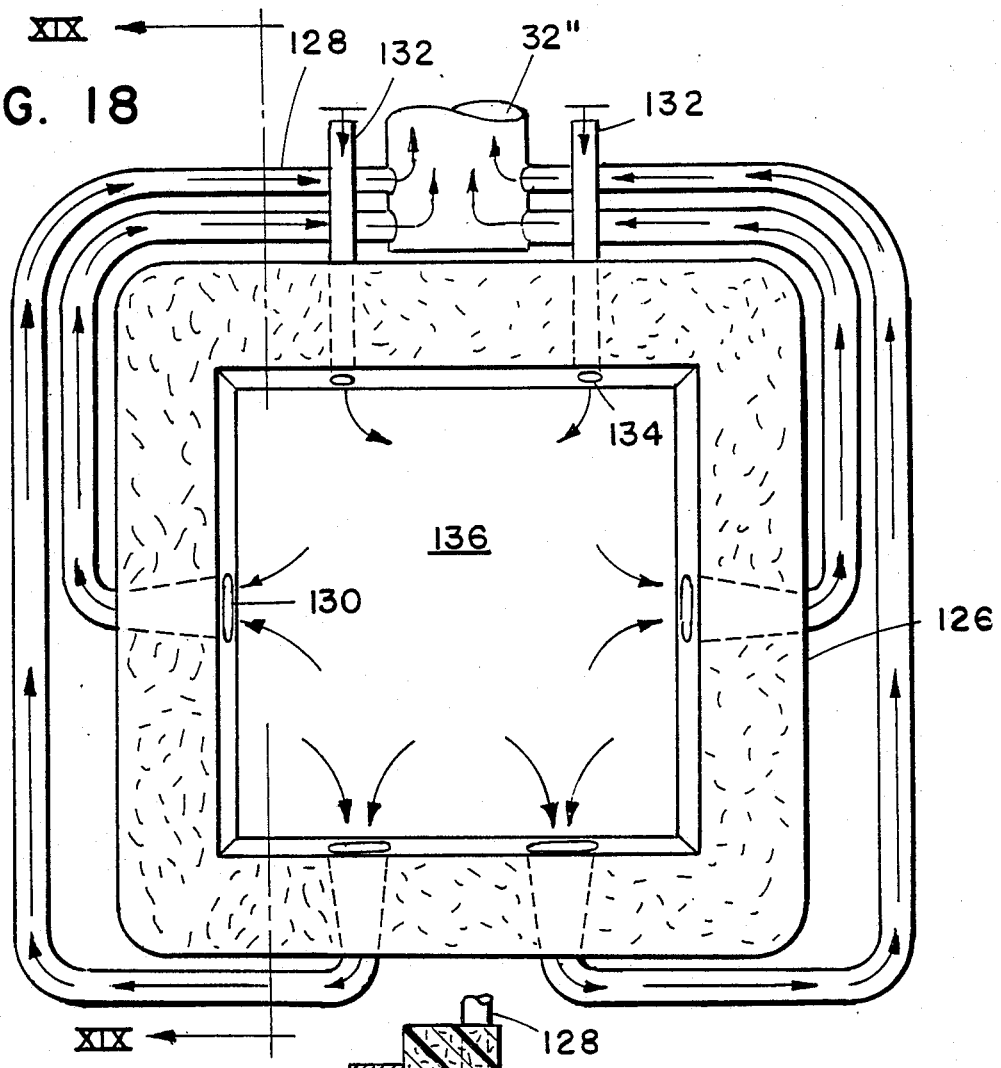
FIG. 18 is a front elevation of a vapor recovery unit according to yet another alternative embodiment.
Figure 19:
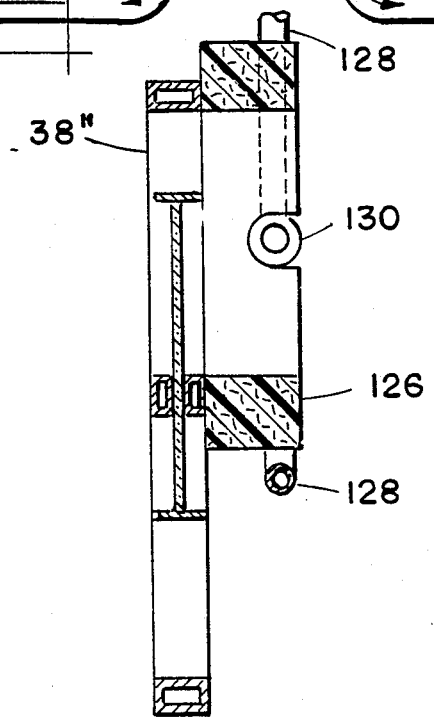
FIG. 19 is a partial sectional view along the lines XIX—XIX in FIG. 18.

Yet another embodiment of the invention is illustrated in FIGS. 18 and 19 in which a collet 126, which is adapted to mount to the frame 38" of the transfer vehicle 22" is a solid piece of closed cell rubberized foam and the area within the boundary of the collet is interconnected with a conduit 32" by a plurality of tubes 128 which are mounted to the forward face of the cabinet of the cleaning machine 82 or reclaiming machine 88. The tubes extend through openings 130 in collet 126 when the collet is brought against the face of the machine. Check valves 132 extend through openings 134 in collet 126 to provide makeup air to the area 136 within the collet purged by the vapor recovery member (not shown). Mechanical fasteners (not shown) would be required to hold frame 38" and collet 126 against the face of the cleaning machine or reclaiming machine during the transfer of articles therethrough.

Changes and modifications in the specifically described embodiments can be carried out without departing from the principles of the invention, which is intended to be limited only by the scope of the appended claims, as interpreted according to the principles of patent law, including the doctrine of equivalents.

The embodiments of the invention in which an exclusive property or privilege is claimed are defined as follows:

1. An apparatus for transferring articles from a solvent cleaning machine adapted for cleaning textile articles to a solvent reclaiming machine adapted for removing solvent from articles, each of said cleaning and reclaiming machines having a front face, an internal article treating chamber, means defining an access opening in said front face to said chamber and access closure means for selectively closing said access opening, said apparatus comprising:

transporting means for transporting articles, said transporting means including wall means defining a substantially enclosed receptacle and means for conveying said receptacle between said cleaning machine and said reclaiming machine;

transfer means for transferring articles from said treating chamber of said cleaning machine to said receptacle and from said receptacle to said reclaiming machine;

said transfer means including means defining an opening in said wall means, closure means for selectively closing said opening and containment means for containing vapor during transfer of articles;

said containment means including sealing means for selectively sealing the portion of said wall means surrounding said transfer opening with the portion of one of said front faces surrounding the associated said access opening, such that said closure means and said access closure closing the associated access opening can be opened with said containment means positioned between said receptacle and one of said cleaning machine and said reclaiming machine.

2. The apparatus in claim 1 in which said containment means further includes vapor recovery means for recovering vapor from said containment means.

3. The apparatus in claim 1 including means for manually manipulating said closure means while said sealing means is sealing said portion of said wall means with said portion of one of said front faces.

4. The apparatus in claim 3 in which said manipulating means includes means defining a sealed recess in said wall means having the configuration of a human hand and arm, such that said closure means can be manipulated from within the space within said receptacle.

5. The apparatus in claim 3 in which said containment means further includes vapor recovery means for recovering vapor from said containment means.

6. The apparatus in claim 1 further including check valve means for providing unidirectional air flow into said containment means.

7. An apparatus for transferring articles from a solvent cleaning machine adapted for cleaning textile articles to a solvent reclaiming machine adapted for removing solvent from articles, each of said cleaning and reclaiming machines having a front face, an internal article treating chamber, means defining an access opening in said front face to said chamber and access closure means for selectively closing said access opening, said apparatus comprising:

wall means defining a substantially enclosed receptacle;

edge means defining a transfer opening in said wall means larger than said access openings, a portion of said wall means surrounding said transfer opening being configured to sealingly interface with said front surfaces of said cleaning and reclaiming machines;

closure means for selectively closing said opening in said wall means; and conveyance means for conveying said apparatus between said cleaning machine and said reclaiming machine.

8. The apparatus in claim 7 further including second wall means extending outwardly from said transfer opening defining a transfer space; vapor recovery means connected with said transfer space and means for positioning said second wall means between said portion of said wall means and one of said front faces; said second wall means having opposite end surfaces defining openings into said transfer space, said openings into said transfer space being larger than said transfer opening and said access openings.

9. The apparatus in claim 8 in which said positioning means includes means for fixedly attaching one of said end surfaces of said second wall means to said portion of said wall means surrounding said opening and means for selectively removably attaching the other one of said end surfaces of said second wall means to said front surface of said cleaning machine and to said front surface of said reclaiming machine.

10. The apparatus in claim 8 in which said positioning means includes means for fixedly attaching one of said end surfaces of said second wall means to one of said front surfaces and means for selectively removably attaching the other one of said end surfaces of said second wall means to said portion of said wall means surrounding said transfer opening.

11. The apparatus in claim 8 further including check valve means in said second wall means for providing unidirectional air flow into said containment transfer space.

12. The apparatus in claim 7 in which a portion of said wall means opposite said transfer opening is an inwardly recessed portion in the shape of human hands and arms providing means for manipulating articles in said receptacle by positioning a user's hands and arms into said recessed portion.

13. The apparatus in claim 7 in which said conveyance means includes a plurality of casters on a bottom portion of said wall means.

14. A system for cleaning textile articles with a volatile solvent and for recovering solvent from said articles, said system comprising:

a solvent cleaning machine having a first cabinet and a first treating chamber within said first cabinet, said first cabinet including means defining an access opening to said first chamber and a first access closure for selectively closing said access opening in said first cabinet;

a first collet attached to said first cabinet surrounding said access opening and including a first outward surface having a predetermined configuration;

a solvent reclaiming machine having a second cabinet and a second treating chamber within said second cabinet, said second cabinet including means defining an access opening to said second chamber and a second access closure for selectively closing said access opening in said second cabinet;

a second collet attached to said second cabinet surrounding said access opening and including a second outward surface having substantially said predetermined configuration; and a transfer vehicle having wall means defining a substantially enclosed portable receptacle, edge means defining a transfer opening in said wall means, transfer closure means for selectively closing said transfer opening and a third outward surface defined by a portion of said wall means surrounding said transfer opening, said third outward surface being configured to selectively sealingly engage said first and second outward surfaces.

15. The system in claim 14 further including vapor recovery means connected with said first and second collets for recovering vapor from said collets when said third outward surface is engaged with one of said first and second outward surfaces and for also recovering vapor from said receptacle and the associated said treating chamber when said transfer closure and associated access closure are open.

16. The system in claim 15 further including check valve means for admitting makeup air into said collets.

17. The system in claim 15 in which each of said collets includes hollow wall means for enclosing a plenum surrounding the associated said access opening and means defining inlet openings in said hollow wall means to said plenum, and wherein said vapor recovery means is connected with each of said plenums.

18. The system in claim 17 further including check valve means for admitting makeup air into said collets.

19. The system in claim 14 in which said portable receptacle includes a lower basket portion for transporting articles and a flexible upper portion covering said lower portion.

20. The system in claim 19 in which said flexible upper portion includes a transparent portion for allowing a user to view the interior of said receptacle.

21. An apparatus for transferring articles from a solvent cleaning machine adapted for cleaning textile articles to a reclaiming machine adapted for reclaiming solvent from such articles, each of said cleaning and reclaiming machines having a front face, an internal article treating chamber, means defining an access opening in said front face to said chamber spaced a predetermined distance from a support surface supporting said cleaning and reclaiming machines, and access closure means for closing said access opening, said apparatus comprising:

an article-containing basket;

caster means for providing mobility to said basket;

a frame member extending from said basket and including means defining a substantially vertically oriented surface having an open portion spaced said predetermined distance above said caster means such that said open portion is aligned with said access openings in said cleaning machine and said reclaiming machine when said vertically oriented surface is facing said front face of the associated said machine;

a closure member mounted to said frame member in a manner that said closure member is operable to selectively close said open portion;

a gas-impermeable flexible shroud extending from said frame member in a manner to cover said basket, said shroud including viewing means for allowing a user to view the interior of said basket and manipulating means for allowing a user to manipulate articles through said open portion and to operate said closure member;

a collet attached to one of said vertically oriented surface or said front face, said collet having opposing planar surfaces configured to sealingly engage said vertically oriented surface and said front face and wall means connecting said opposing planar surfaces, said wall means defining a transfer space between said opposing planar surfaces;

a vapor recovery unit connected with said collet such that said vapor recovery unit removes vapor from said transfer space; and check valve means for providing unidirectional air flow into said transfer space.

22. The transfer apparatus in claim 21 including a pair of said collets, one of said collets attached to the front face of said cleaning machine and the other of said collets attached to the front face of said reclaiming machine.

23. The transfer apparatus in claim 21 in which said viewing means includes a transparent portion of said shroud.

24. The transfer apparatus in claim 21 further including flexible support means connected between said frame and said shroud for supporting said viewing means above said basket.

* * * * *